US009562541B2

(12) United States Patent
Iwakiri et al.

(10) Patent No.: US 9,562,541 B2
(45) Date of Patent: Feb. 7, 2017

(54) SCROLL STRUCTURE OF CENTRIFUGAL COMPRESSOR

(75) Inventors: Kenichiro Iwakiri, Tokyo (JP); Isao Tomita, Tokyo (JP); Takashi Shiraishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 485 days.

(21) Appl. No.: 13/981,042

(22) PCT Filed: Jan. 27, 2012

(86) PCT No.: PCT/JP2012/051891

§ 371 (c)(1),
(2), (4) Date: Aug. 12, 2013

(87) PCT Pub. No.: WO2012/124388

PCT Pub. Date: Sep. 20, 2012

(65) Prior Publication Data

US 2013/0343885 A1 Dec. 26, 2013

(30) Foreign Application Priority Data

Mar. 17, 2011 (JP) ..... 2011-059935

(51) Int. Cl.
*F04D 29/42* (2006.01)
*F04D 29/44* (2006.01)
*F04D 29/66* (2006.01)

(52) U.S. Cl.
CPC ..... *F04D 29/44* (2013.01); *F04D 29/4206* (2013.01); *F04D 29/441* (2013.01); *F04D 29/667* (2013.01); *F05D 2250/52* (2013.01)

(58) Field of Classification Search
CPC .... F04D 29/4206; F04D 29/44; F04D 29/441; F04D 29/667; F05D 2250/52
(Continued)

(56) References Cited

U.S. PATENT DOCUMENTS 494,890 A 4/1893 Rateau
5,624,229 A 4/1997 Kotzur et al.
(Continued)

FOREIGN PATENT DOCUMENTS

CN 101684827 A 3/2010
EP 2180192 A1 4/2010
(Continued)

OTHER PUBLICATIONS

Extended European Search Report for European Application No. 12757491.1, dated Nov. 13, 2014.
(Continued)

*Primary Examiner* — Nicholas J Weiss
*Assistant Examiner* — Dapinder Singh
(74) *Attorney, Agent, or Firm* — Birch, Stewart, Kolasch & Birch, LLP

(57) ABSTRACT

An axial cross-sectional shape of a scroll flow path 13 is a roughly circular shape, a diffuser outlet connected to the roughly circular shape is shifted to a position which is closer to a circle center than to a position of a tangent line to the circular shape and which does not reach the circle center, the circular shape is formed from a scroll chamber 30 which juts out in the axial direction relative to the position of the diffuser outlet 11*a* and a shift chamber 32 that forms a remainder of the roughly circular shape in a direction opposite to the scroll chamber 30, and the shift chamber 32 is at least formed on the scroll flow path 13 of a winding end portion 19 in a circumferential direction of a spiral.

7 Claims, 9 Drawing Sheets

(58) Field of Classification Search
USPC ..... 415/204, 206, 208.4
See application file for complete search history.

(56) References Cited

U.S. PATENT DOCUMENTS

| | | | | |
|---|---|---|---|---|
| 2006/0081226 | A1 | 4/2006 | Bolz | |
| 2010/0178163 | A1 | 7/2010 | Dettmann et al. | |
| 2011/0194931 | A1* | 8/2011 | Swiatek | F04D 29/444 415/206 |

FOREIGN PATENT DOCUMENTS

| | | | |
|---|---|---|---|
| JP | 156135 | C2 | 4/1943 |
| JP | 58-92423 | U | 6/1983 |
| JP | 3-217699 | A | 9/1991 |
| JP | 5-42699 | U | 6/1993 |
| JP | 8-503284 | A | 4/1996 |
| JP | 10-252696 | A | 9/1998 |
| JP | 11-303796 | A | 11/1999 |
| JP | 2000-64994 | A | 3/2000 |
| JP | 2005-2951 | A | 1/2005 |
| JP | 2006-501397 | A | 1/2006 |
| JP | 2007-211717 | A | 8/2007 |
| JP | 4492045 | B2 | 4/2010 |
| JP | 2010-529358 | A | 8/2010 |
| WO | WO 95/08050 | A1 | 3/1995 |
| WO | WO 2004/031590 | A1 | 4/2004 |

OTHER PUBLICATIONS

Decision to Grant a Patent effective Feb. 24, 2014 issued in corresponding Japanese Application No. 2011-059935 with English Translation.
Chinese Office Action for Chinese Application No. 201280012280.7, dated May 25, 2015, along with an English translation thereof.
International Preliminary Report on Patentability mailed on Sep. 26, 2013 issued in PCT/JP2012/051891 wtih an English Translation.
International Search Report for International Application No. PCT/JP2012/051891 with an English Translation.
Notice of Allowance effective May 3, 2016 issued in the corresponding Chinese Application No. 201280012280.7 with English Translation.
Chinese Notice of Allowance dated Apr. 5, 2016 issued in Chinese Application No. 201180046268.3 with an English Translation.
Decision to Grant a Patent issued Jan. 7, 2014 in corresponding Japanese Application No. 2010-294079 with English Translation.
International Preliminary Report on Patentability mailed on Jul. 18, 2013 issued in PCT/JP2011/078060 with an English Translation.
Office Action effective Feb. 28, 2015 issued in corresponding Chinese Application No. 201180046268.3 with an English Translation.

* cited by examiner

SCROLL STRUCTURE OF CENTRIFUGAL COMPRESSOR

TECHNICAL FIELD

The present invention relates to a scroll structure (scroll chamber structure) of a centrifugal compressor used in a vehicular turbocharger, a marine turbocharger, and the like.

BACKGROUND ART

A centrifugal compressor which is used in a compressor portion or the like of a vehicular turbocharger or a marine turbocharger imparts kinetic energy to a fluid via rotations of an impeller and increases pressure due to centrifugal force by discharging the fluid outward in a radial direction.

Such centrifugal compressors are required to have a high pressure ratio and high efficiency over a wide operating range. Accordingly, various concepts have been devised and implemented for scroll structures.

As prior art, for example, Patent Document 1 (Japanese Patent No. 4492045) describes a technique with respect to a centrifugal compressor comprising a casing provided with a spirally formed scroll flow path, wherein the scroll flow path is formed such that a flow path width in an axial direction gradually increases from inward to outward in a radial direction and the flow path width is maximum on an outer side in the radial direction of an intermediate point of the flow path width in the radial direction.

In addition, Patent Document 2 (Japanese Translation of PCT Application No. 2010-529358) describes a centrifugal compressor for a turbocharger, wherein the centrifugal compressor comprises a spiral housing and a diffuser, and the diffuser is formed with an enlarged diameter so as to reduce a negative pressure range in a transitional region or a region in which a tongue portion is positioned in the spiral housing.

Patent Document 1: Japanese Patent No. 4492045

Patent Document 2: Japanese Translation of PCT Application No. 2010-529358

Although improvements of a cross-sectional shape of a scroll flow path such as that described in Patent Document 1 and improvements of a diffuser portion such as that described in Patent Document 2 have been made, further improvements are required to enhance compressor efficiency.

As shown in FIGS. 12 and 13, a diffuser 02 is formed on an outer circumferential side of an impeller 01 of a compressor and a scroll flow path 03 is provided on an outer circumferential side of the diffuser 02. A cross-sectional shape of the scroll flow path 03 is generally formed in a circular shape, and a flow path connection 04 at a winding start and a winding end of the scroll flow path 03 is connected at a tongue portion 05. In addition, discharge subsequent to the winding end is to be performed through an outlet flow path 06.

FIG. 13 shows, on top of each other, scroll cross-sectional shapes taken at angles θ1, θ2, . . . which occur at intervals of a predetermined angle Δθ in a clockwise direction from the tongue portion 05.

At the tongue portion 05, as indicated by the hatched lines in FIG. 13, the flow path connection 04 is shaped such that a circular portion 09 is connected to an outlet portion 011 of the diffuser 02 that is tangent to the circular portion 09.

In addition, in a vicinity of the tongue portion 05, there is a problem that a separated flow is created due to interference between a diffuser outlet flow A and a scroll flow path internal spiral flow B, which results in flow loss. The interference between the diffuser outlet flow A and the scroll flow path internal spiral flow B will now be described with reference to FIG. 9B. FIG. 9B is a sectional view taken along line C-C in FIG. 12, in which the outlet flow path 06 with a circular cross-sectional shape and the scroll flow path 03 with a circular cross-sectional shape intersect with each other to create a ridge line P at an intersection in the vicinity of the tongue portion 05. Therefore, the diffuser outlet flow A has an upward velocity component in the vicinity of the tongue portion 05 and interferes with the scroll flow path internal spiral flow B. Due to the interference, a separation of flow is created in the vicinity of the tongue portion 05 and causes flow loss.

DISCLOSURE OF THE INVENTION

Based on these findings, an object of the present invention is to review a cross-sectional shape of a scroll including a connection to a diffuser outlet in the vicinity of a tongue portion of a scroll flow path as well as over an entire circumference of the scroll and to provide a scroll structure of a centrifugal compressor which improves an effect of loss reduction over a wide operating range including high flow rate operations and low flow rate operations.

In order to solve the problem described above, the present invention provides a scroll structure of a centrifugal compressor comprising a diffuser which is provided on an outer circumferential side of an impeller and a scroll flow path which is formed in a spiral shape that connects to an outer circumference of the diffuser, wherein an axial cross-sectional shape of the scroll flow path is a roughly circular shape, a diffuser outlet connected to the roughly circular shape is shifted to a position which is closer to a circle center than to a position of a tangent line to the circular shape and which does not reach the circle center, the roughly circular shape is formed from a scroll chamber which juts out in the axial direction relative to the position of the diffuser outlet and a shift chamber that forms a remainder of the roughly circular shape in a direction opposite to the scroll chamber, and the shift chamber is at least formed on the scroll flow path of a winding end portion in a circumferential direction of a spiral.

According to the present invention, in a cross-sectional shape of a scroll flow path at a winding end portion in a circumferential direction, by giving an axial cross-sectional shape of the scroll flow path a roughly circular shape, forming a diffuser outlet connected to the roughly circular shape at a position which is closer to a circle center than to a position of a tangent line to the circular shape, and forming the roughly circular shape from a scroll chamber which juts out in the axial direction relative to the position of the diffuser outlet and a shift chamber that forms a remainder of the roughly circular shape in a direction opposite to the scroll chamber, as shown in FIG. 9A the diffuser outlet flow A has a velocity component that is oriented downward (downward as depicted in FIG. 9A) in a direction of an axis of rotation of a compressor along a wall surface of the scroll flow path.

Therefore, since a direction of the diffuser outlet flow A can be conformed to the flow of the scroll flow path internal spiral flow Bas shown in FIG. 9A, interference between the diffuser outlet flow A and the scroll flow path internal spiral flow B can be prevented and an occurrence of separation in the vicinity of the tongue portion attributable to the interference can be minimized.

In addition, in conventional art (FIG. 9B), a circular cross-sectional shape and a circular cross-sectional shape intersect with each other out of alignment to cause an intersection to bulge in a mountain shape and create a ridge line P. However, in the present invention, by shifting a connection position of the diffuser outlet to a position which is closer to a circle center than to a position of a tangent line to the circular shape as shown in FIG. 9A, even if a circular shape and a circular shape intersect with each other out of alignment, a ridge line is less likely to be created at the intersection. Therefore, according to the present invention, the occurrence of the ridge line Pin the vicinity of the tongue portion can be minimized and a distance of a ridge line portion can be reduced. As a result, since interference between the diffuser outlet flow A and the scroll flow path internal spiral flow B that occurs at the ridge line portion can be minimized, an occurrence of separation attributable to the interference can be minimized and flow loss can be reduced.

As described above, according to the present invention, conforming the direction of the diffuser outlet flow A to the flow of the scroll flow path internal spiral flow B and minimizing the occurrence of a ridge line in the vicinity of the tongue portion to reduce ridge line distance combine to minimize interference between the diffuser outlet flow A and the scroll flow path internal spiral flow B, thereby minimizing an occurrence of separation in the vicinity of the tongue portion attributable to the interference and reducing flow loss.

In addition, in the present invention, favorably, the shift chamber starts shifting from a position approximately 180 degrees preceding the winding end portion in a circumferential direction and increases so as to reach maximum at a position of approximately 360 degrees, and a shift amount increases linearly or parabolically as a circumferential angle increases.

As described above, by gradually increasing a shift amount over a range of approximately 180 degrees in a circumferential direction, a shape of the shift chamber in a circumferential direction changes in a smooth manner to minimize loss in a flow in a circumferential direction in the scroll flow path.

Furthermore, in the present invention, favorably, the shift chamber is further formed in the scroll flow path of a winding start portion.

In a flow field during a low flow rate operation, pressure rises from the vicinity of the tongue portion of the scroll flow path toward the output flow path. Therefore, in the vicinity of the tongue portion, a recirculating flow from a high-pressure side of the outlet flow path (winding end portion of the scroll flow path) toward a low-pressure side (winding start portion of the scroll flow path) is created (an arrow Z in FIG. 11A; a spiral flow is created in the direction of the arrow Z accompanied by the scroll flow path internal spiral flow B).

On the other hand, in a flow field during a high flow rate operation, pressure conversely drops from the vicinity of the tongue portion of the scroll flow path toward the output flow path. Therefore, in the vicinity of the tongue portion, a flow towards the output flow path is created (an arrow Y in FIG. 11B; a spiral flow is created in the direction of the arrow Y accompanied by the scroll flow path internal spiral flow B).

Therefore, during a high flow rate operation, a flow is created in the direction of the arrow Y (FIG. 11B) accompanied by the scroll flow path internal spiral flow B. In this process, interference between the scroll flow path internal spiral flow B and the diffuser outlet flow A is prevented as described above by conforming the direction of the diffuser outlet flow A to the flow of the scroll flow path internal spiral flow B and minimizing the occurrence of a ridge line in the vicinity of the tongue portion to reduce ridge line distance. As a result, an occurrence of separation in the vicinity of the tongue portion attributable to the interference is minimized and flow loss is reduced.

In addition, in the present invention, favorably, a shape of a connection opening of the scroll flow path of the winding start portion to the winding end portion is formed in a flat shape having a height that is equal to a width of the diffuser outlet, the shift chamber is provided on one side of the flat shape, and a height of the shift chamber varies in the circumferential direction.

As described above, forming a shift chamber in a winding start portion is effective in reducing flow loss that occurs in a flow from the vicinity of the tongue portion toward the side of the outlet flow path during a high flow rate operation. In addition to this effect, by forming a shape of a connection opening of the scroll flow path of the winding start portion to the winding end portion in a flat shape having a height that is equal to a width of the diffuser outlet, a circulation area can be reduced in comparison to a connection having a circular cross-sectional shape. As a result, inflow of the recirculating flow (the arrow Z in FIG. 11A) from the output flow path (the winding end portion of the scroll flow path) toward the vicinity of the tongue portion that is created during a low flow rate operation can be minimized.

Furthermore, as shown in FIG. 10B, since an opening of the winding start portion is formed in a flat shape having a height that is equal to a width of the diffuser outlet, inflow of the scroll flow path internal spiral flow B of the outlet flow path (the winding end portion of the scroll flow path) as a scroll flow path internal inflow E of the winding start portion is prevented. As a result, flow loss due to separation in an arc-shaped cross section of the winding start portion such as that shown in FIG. 10A can be reduced.

Furthermore, in the present invention, favorably, the shift chamber is formed on the entire scroll flow path in the circumferential direction.

Since the shift chamber is formed over an entire circumference in this manner, operational effects attributable to the formation of the shift chamber in the winding start portion and the winding end portion are produced. At the same time, compared to forming the shift chamber in one portion in the circumferential direction, manufacturing is simplified and flow loss in the circumferential direction in the scroll flow path can be minimized.

According to the present invention, by giving an axial cross-sectional shape of the scroll flow path a roughly circular shape, forming a diffuser outlet connected to the roughly circular shape at a position which is closer to a circle center than to a position of a tangent line to the circular shape, and forming the roughly circular shape from a scroll chamber which juts out in the axial direction relative to the position of the diffuser outlet and a shift chamber that forms a remainder of the roughly circular shape in a direction opposite to the scroll chamber, as shown in FIG. 9A, the diffuser outlet flow A has a velocity component that is oriented downward in an axial direction along a wall surface of the scroll flow path.

Therefore, since a direction of the diffuser outlet flow A can be conformed to the flow of the scroll flow path internal spiral flow B as shown in FIG. 9A, interference between the diffuser outlet flow A and the scroll flow path internal spiral flow B can be prevented, an occurrence of separation in the vicinity of the tongue portion attributable to the interference can be minimized, and an effect of loss reduction can be enhanced.

In addition, in conventional art (FIG. 9B), a circular cross-sectional shape and a circular cross-sectional shape intersect with each other out of alignment to cause an intersection to bulge in a mountain shape and create a ridge line P. However, in the present invention, by shifting a connection position of the diffuser outlet to a position which is closer to a circle center than to a position of a tangent line to the circular shape as shown in FIG. 9A, even if a circular shape and a circular shape intersect with each other out of alignment, a ridge line is less likely to be created at the intersection. Therefore, according to the present invention, the occurrence of the ridge line P in the vicinity of the tongue portion can be minimized and a distance of a ridge line portion can be reduced. As a result, since interference between the diffuser outlet flow A and the scroll flow path internal spiral flow B that occurs at the ridge line portion can be minimized, an occurrence of separation attributable to the interference can be minimized and flow loss can be reduced.

BRIEF DESCRIPTION OF THE DRAWINGS

FIG. 6 is a set of explanatory diagrams showing a fourth embodiment of a scroll cross-sectional shape, wherein

FIG. 9 is a set of sectional views of an intersection between a winding start portion and a winding end portion of a scroll flow path, wherein

FIG. 10 is a set of sectional views taken along line D-D in FIG. 2, wherein

FIG. 11 is a set of explanatory diagrams of a flow field in a vicinity of a tongue portion, wherein

BEST MODE FOR CARRYING OUT THE INVENTION

Figure 1:
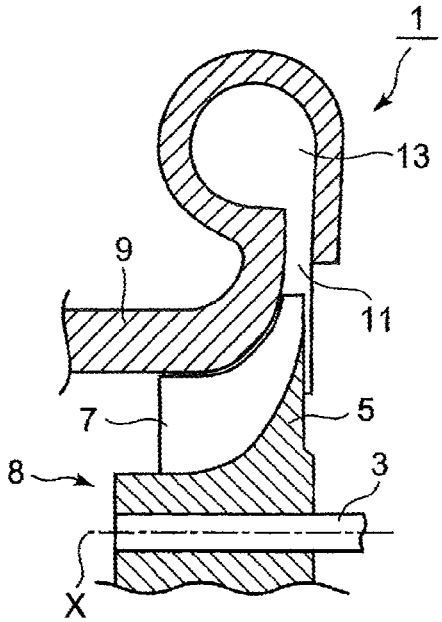
FIG. 1 is an axial sectional schematic view showing a scroll structure of a centrifugal compressor according to the present invention.

Hereinafter, the present invention will be described in detail with reference to the embodiments illustrated in the drawings.

However, it is to be understood that, unless otherwise noted, dimensions, materials, shapes, relative arrangements, and the like of components described in the embodiments are not intended to limit the scope of the invention thereto and are merely illustrative examples.

(First Embodiment)

FIG. 1 shows a schematic diagram of an axial cross-section of a centrifugal compressor 1 according to the present invention. The present embodiment represents a centrifugal compressor 1 applied to a turbocharger, wherein a plurality of compressor blades 7 is erected on a surface of a hub 5 fixed to a rotary shaft 3 driven by a turbine (not shown) and a compressor housing 9 covers the outside of the compressor blades 7. In addition, a diffuser 11 is formed on an outer circumferential side of the compressor blades 7, and a scroll flow path 13 is formed around and connected to the diffuser 11.

Figure 2:
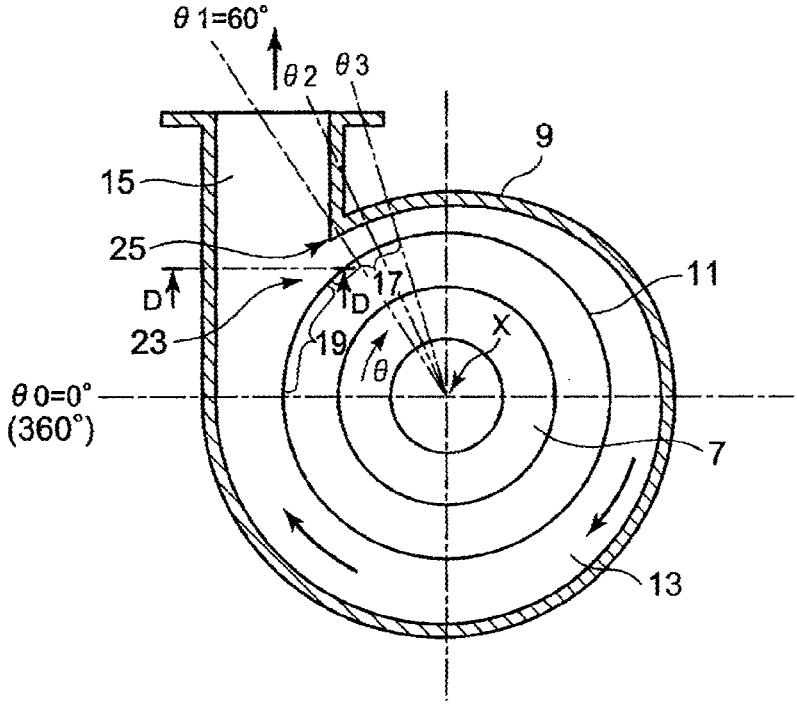
FIG. 2 is an overall sectional view showing the scroll structure of a centrifugal compressor according to the present invention.

FIG. 2 shows an overall sectional view of the scroll flow path 13. The compressor housing 9 comprises the scroll flow path 13 and a linear outlet flow path 15 which communicates with the scroll flow path 13. A flow path sectional area of the scroll flow path 13 increases as a winding angle θ increases from a winding start portion 17 of the scroll flow path 13 in a clockwise direction as shown in FIG. 2. The scroll flow path 13 reaches a winding end portion 19 when the winding angle θ exceeds and increases beyond approximately 360°=0°.

In addition, a cross-sectional shape of the scroll flow path 13 in an axial direction of the rotary shaft 3 has a roughly circular shape. Furthermore, in the present embodiment, as shown in FIG. 2, the winding angle θ is set such that a horizontal position is at θ=0°and a line connecting a position of a tongue portion 25 of a flow path connection 23 where the winding start and the winding end of the scroll flow path 13 intersect with each other and a center X of an axis of rotation of a compressor wheel 8 is at approximately θ=60°.

Next, the cross-sectional shape of the scroll flow path 13 will be described.

Figure 3A:
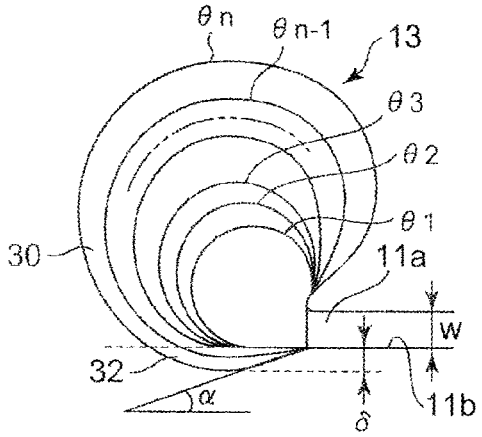
FIG. 3A is an explanatory diagram showing a first embodiment of a scroll cross-sectional shape.

As shown in FIG. 3A, at the winding start portion 17, a cross-sectional shape of the flow path connection 23 where the winding start portion 17 and the winding end portion 19 of the scroll flow path 13 intersect with each other includes connecting an outlet portion ll*a* of the diffuser 11 which connects to the roughly circular shape at a position of a tangent line to the circular shape, and the connection relationship due to the tangential state to the circular shape continues until the winding angle θ reaches approximately 360°=0°.

Subsequently, in a region of the winding end portion 19 where the winding angle θ reaches the tongue portion 25 at approximately 60°, the cross-sectional shape of the scroll flow path 13 changes such that the outlet portion 11*a* of the diffuser 11 is then in a relative position more closely aligned with the center of the generally circular cross section and further from the position that is tangential to the circular cross sectional shape. The change in cross section of the scroll flow path does not result, however, in the outlet portion being aligned with the center of the circular cross section. The roughly circular cross sectional shape is formed from a scroll chamber 30 which juts out in the axial direction (upward in FIG. 3) relative to the position of the outlet portion 11*a* of the diffuser 11 and a shift chamber 32 that forms a remainder of the roughly circular shape in a direction opposite to the scroll chamber 30 (downward in FIG. 3). In other words, the shift chamber 32 forms a bottom surface portion of the circular shape.

Moreover, while the cross-sectional shape of the scroll flow path as a whole which combines the scroll chamber 30 and the shift chamber 32 is described as a roughly circular shape, it is to be understood that the roughly circular shape, in accordance with the invention, also includes an oval shape, an ellipse shape, and the like which approximate a circle.

As exemplified by shapes at positions of $\theta_n$ and $\theta_{n-1}$ in FIG. 3, the cross-sectional shape of the scroll flow path 13 at the winding end portion 19 is shifted downward by a shift amount δ from a bottom surface 11*b* of the outlet portion 11*a* of the diffuser 11.

In addition, a lower surface of the shift chamber 32 may be formed by an inclined surface that is, set at an inclination angle α with respect to an end portion of the bottom surface 11*b* of the diffuser 11 instead of by an arc surface.

Figure 3B:
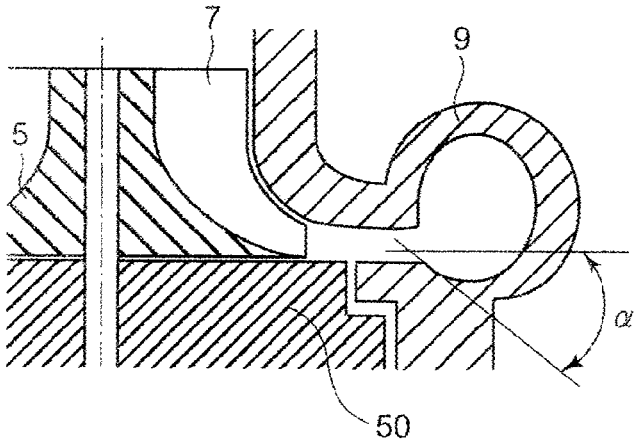
FIG. 3B shows an example in which a compressor housing is given an inclination angle α.
Figure 3C:
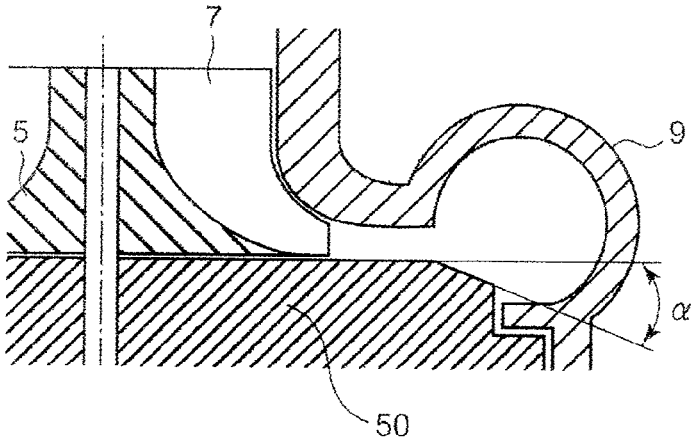
FIG. 3C shows an example in which a bearing housing is given an inclination angle α.

Moreover, the arc surface or the inclined surface provided on the lower surface of the shift chamber 32 may be provided on a bearing housing 50 as shown in FIG. 3C instead of on the compressor housing 9 as shown in FIG. 3B.

In this case, when the inclination angle is particularly large, the diffuser outlet flow may not flow along the inclined surface and may cause separation. In consideration thereof, a favorable range of the inclination angle α is approximately 3 to 25 degrees. A more favorable range is 3 to 15 degrees, and an optimal range is 3 to 8 degrees. The inclination angle α is also included in the range described above in an optimal range of the shift amount δ. However, the inclined surface need not necessarily be linear. In this case, an angle formed by connecting a lower surface of the diffuser outlet and a lower surface of the shift chamber may be considered to be the inclination angle α.

Figure 10A:
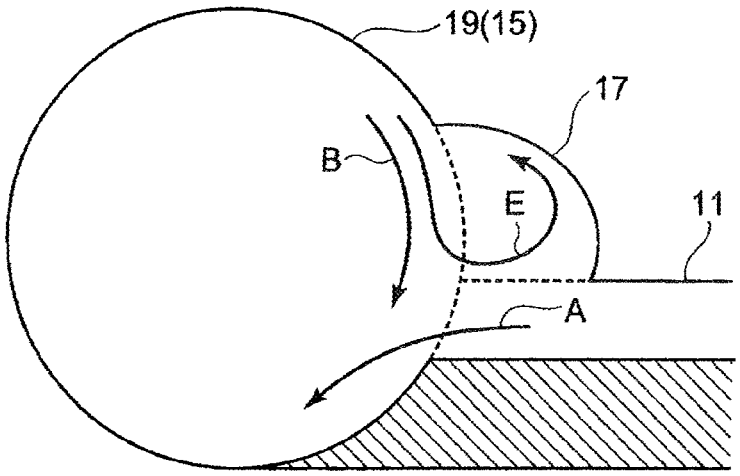
FIG. 10A represents the first to third embodiments and FIG. 10B represents the fourth embodiment.

By forming the shift chamber 32 described above at a position below the bottom surface 11*b* of the outlet portion 11*a*, the diffuser outlet flow is converted to a velocity component that is oriented downward in an axial direction along a wall surface as shown in FIG. 10A. Therefore, since directions of the diffuser outlet flow A and the scroll flow path internal spiral flow B conform to each other as shown in FIG. 10A, a collision between the scroll flow path internal spiral flow B and the diffuser outlet flow A is avoided and loss is minimized and, at the same time, an occurrence of separation in the vicinity of the tongue portion is minimized.

Moreover, the cross sectional shape of the scroll flow path can be modified such that the diffuser outlet is aligned with the circle center of the circular cross section. However, when such a shape is adopted, the diffuser outlet flow A is uniformly divided into upward and downward directions in the scroll flow path 13. In this case, a spiral direction of the scroll flow path internal spiral flow B does not stabilize and interference between the flows causes flow loss.

Figure 9A:
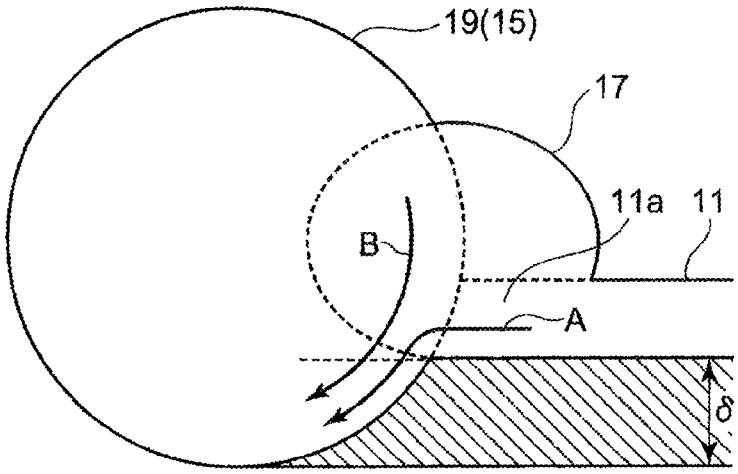
FIG. 9A represents the present invention and is a sectional view taken along line D-D in FIG. 2.

As a result, as shown in FIG. 9A, the outlet portion 11*a* of the diffuser 11 is aligned with a position which is closer to a the center of the cross section than to a position that is tangential to the circular shape but which is not aligned with the circle center.

Therefore, according to the present embodiment, since the shift chamber 32 is formed in the scroll flow path 13 in the winding end portion 19 in the circumferential direction of the spiral, interference between the diffuser outlet flow A and the scroll flow path internal spiral flow B in the vicinity of the tongue portion 25 that is a connection between the winding end portion 19 and the winding start portion 17 is prevented. As a result, an occurrence of separation in the vicinity of the tongue portion attributable to the interference is minimized and an occurrence of flow loss is minimized.

In other words, in a cross-sectional shape of the scroll flow path 13 at the winding end portion 19 in the circumferential direction, by giving an axial cross-sectional shape of the scroll flow path 13 a roughly circular shape, forming the outlet portion 11*a* of the diffuser 11 connected to the roughly circular shape at a position which is closer to a circle center than to a position of a tangent line to the circular shape, and forming the roughly circular shape from the scroll chamber 30 which juts out in the axial direction relative to the position of the outlet portion 11*a* of the diffuser 11 and the shift chamber 32 that forms a remainder of the roughly circular shape in a direction opposite to the scroll chamber 30, the diffuser outlet flow A has a velocity component that is oriented downward in an axial direction along a wall surface of the scroll flow path as shown in FIG. 9A.

Therefore, since a direction of the diffuser outlet flow A can be conformed to the flow of the scroll flow path internal spiral flow B as shown in FIG. 9A, interference between the diffuser outlet flow A and the scroll flow path internal spiral flow B can be prevented and an occurrence of separation in the vicinity of the tongue portion attributable to the interference can be minimized.

Figure 9B:
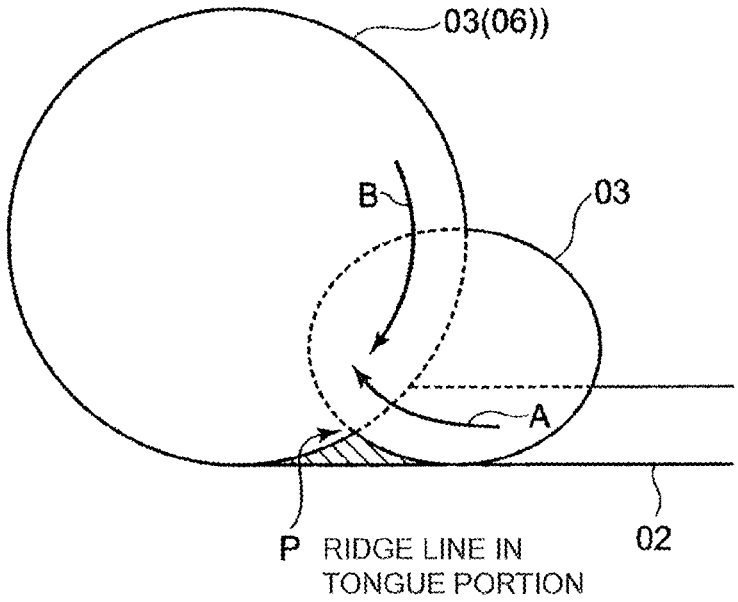
FIG. 9B represents conventional art and is a sectional view taken along line C-C in FIG. 12.

In addition, in conventional art (FIG. 9B), a circular cross-sectional shape and a circular cross-sectional shape intersect with each other out of alignment to cause an intersection to bulge in a mountain shape and create a ridge line P. However, in the present embodiment, by shifting a connection position of the outlet portion 11*a* of the diffuser to a position which is closer to a circle center than to a position of a tangent line to the circular shape and which does not reach the circle center as shown in FIG. 9A, even if a circular shape and a circular shape intersect with each other out of alignment, a ridge line is less likely to be created at the intersection. Therefore, the occurrence of the ridge line Pin the vicinity of the tongue portion can be minimized and a distance of a ridge line portion can be reduced.

As a result, since interference between the diffuser outlet flow A and the scroll flow path internal spiral flow B that occurs at the ridge line portion can be minimized, an occurrence of separation attributable to the interference can be minimized and flow loss can be reduced.

As described above, according to the present embodiment, conforming the direction of the diffuser outlet flow A to the flow of the scroll flow path internal spiral flow B and minimizing the occurrence of the ridge line P in the vicinity of the tongue portion 25 to reduce ridge line distance combine to minimize interference between the diffuser outlet flow A and the scroll flow path internal spiral flow B, thereby minimizing an occurrence of separation in the vicinity of the tongue portion attributable to the interference and reducing flow loss.

In addition, the shift chamber 32 is to start shifting from a position approximately 180 degrees preceding the winding end portion 19 in a circumferential direction and increase so as to reach maximum at a position of approximately 360 degrees, and a shift amount δ increases linearly or parabolically as a circumferential angle increases.

Figure 8:
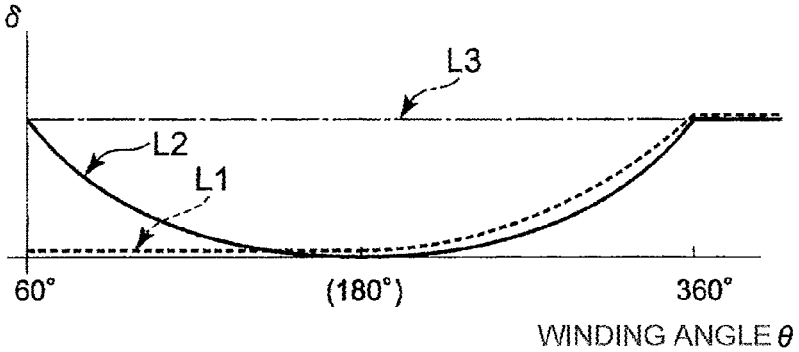
FIG. 8 is an explanatory diagram showing a variation in a shift amount of a shift chamber with respect to angles in the circumferential direction.

Specifically, as depicted by a dotted line L1 in FIG. 8, the shift chamber 32 starts shifting from a position where the winding angle θ is approximately 180° and reaches a predetermined shift amount δ at a position where the winding angle θ is approximately 360°=0° is established. The predetermined shift amount δ is subsequently retained in the winding end portion 19.

As described above, by gradually increasing a shift amount δ over a range of approximately 180 degrees in the circumferential direction, the shape of the shift chamber 32 in the circumferential direction changes in a smooth manner to minimize loss in a flow in the circumferential direction in the scroll flow path 13.

(Second Embodiment)

Next, a second embodiment will be described with reference to FIG. 4.

The second embodiment is characterized in that, in addition to the shift chamber 32 according to the first embodiment, a shift chamber 34 is further formed in the scroll flow path 13 in the winding start portion 17.

Figure 4:
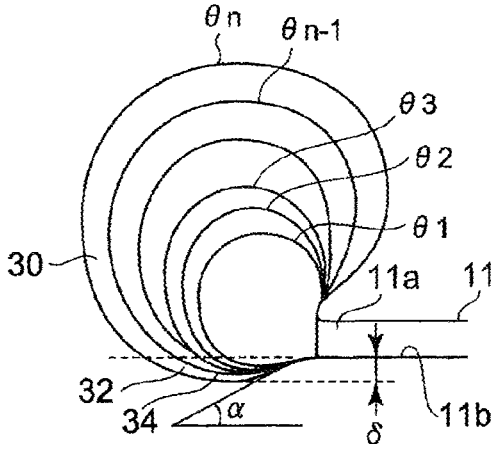
FIG. 4 is an explanatory diagram showing a second embodiment of a scroll cross-sectional shape.

As shown in FIG. 4, the shift chamber 34 that is similar to the shift chamber 32 described in the first embodiment is formed in the winding start portion 17 in which the winding angle θ is in a range of $\theta_1$, $\theta_2$, and $\theta_3$. In addition, a lower surface of the shift chamber 34 may be formed by an inclined surface that is set at an inclination angle α with respect to an end portion of the bottom surface 11*b* of the diffuser 11 instead of by an arc surface.

As for the shift amounts δ of the shift chamber 32 and the shift chamber 34, as indicated by a solid line L2 in FIG. 8, the shift amount of the shift chamber 34 is δ at a winding angle θ=60° at winding start (the position of the tongue portion 25) and subsequently decreases down to zero at θ=180°. Subsequently, the shift amount of the shift chamber 32 increases and reaches a predetermined shift amount δ at θ=360°, and the shift amount δ is retained in the winding end portion 19. The shift amount δ increases or decreases linearly or parabolically as a circumferential angle increases.

While the shift amount δ has a value of zero at θ=180° in the description above, this is merely an example and θ may vary depending on design conditions.

Figure 11A:
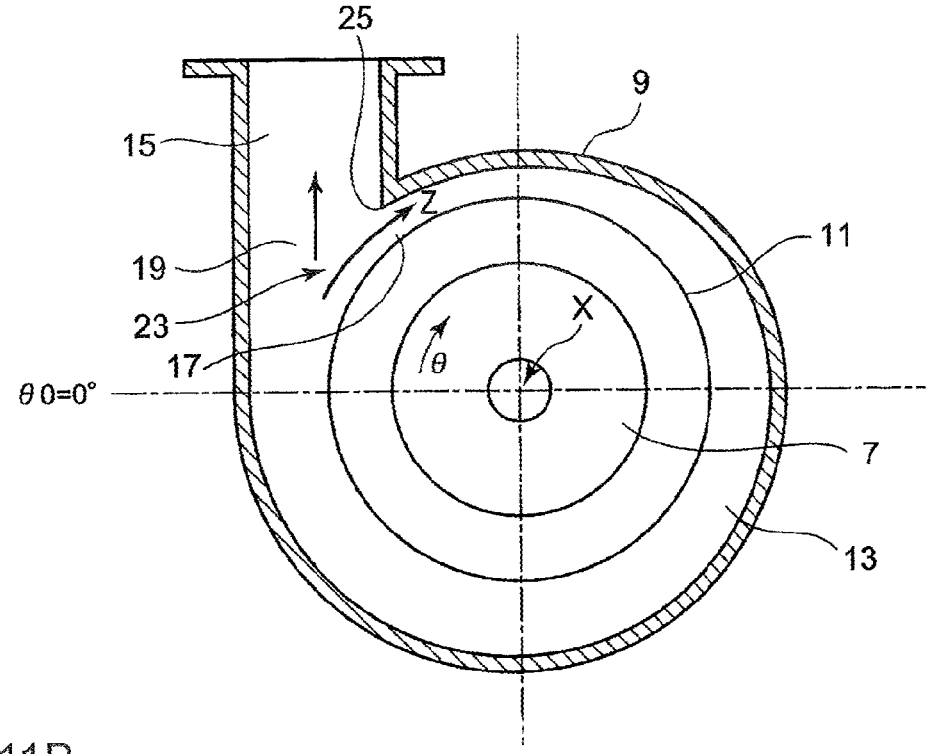
FIG. 11A shows a flow in the vicinity of the tongue portion when flow rate is low and FIG. 11B shows a flow when flow rate is high.

In a flow field during a low flow rate operation, pressure rises from the vicinity of the tongue portion 25 of the scroll flow path 13 toward the output flow path 15. Therefore, in the vicinity of the tongue portion 25, a recirculating flow (the arrow Z in FIG. 11A) from a high-pressure side of the outlet flow path 15 (the winding end portion 19) toward a low-pressure side (the winding start portion 17) is created. The recirculating flow spirals and flows in the direction of the arrow Z, accompanied by the scroll flow path internal spiral flow B.

Figure 11B:
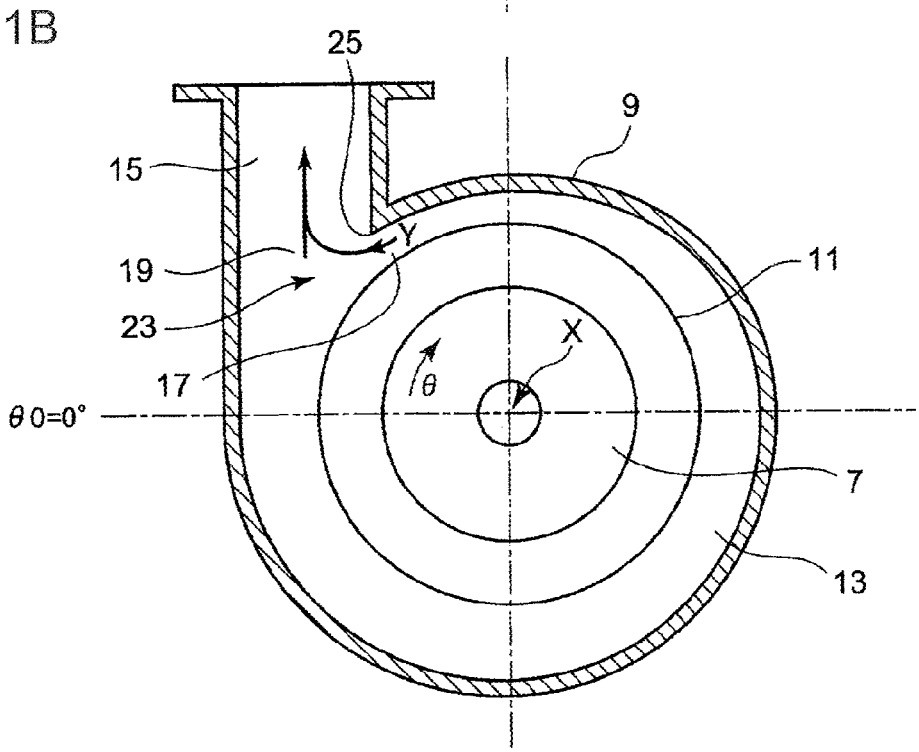
Figure 12:
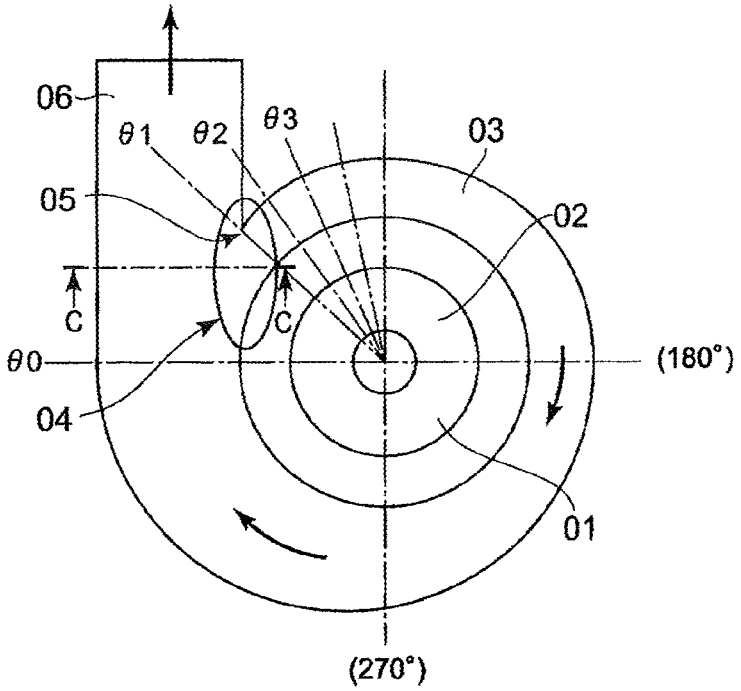
FIG. 12 is an explanatory diagram of conventional art.
Figure 13:
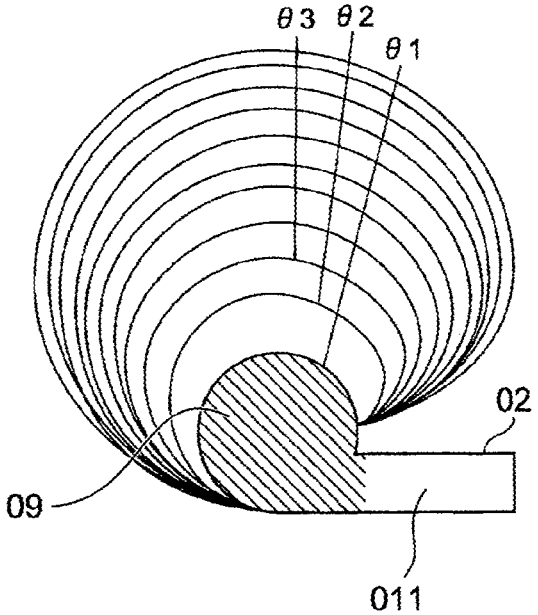
FIG. 13 is an explanatory diagram of conventional art.

On the other hand, in a flow field during a high flow rate operation, pressure conversely drops from the vicinity of the tongue portion 25 of the scroll flow path 13 toward the output flow path 15. Therefore, in the vicinity of the tongue portion 25, a flow (the arrow Y in FIG. 11B) towards the output flow path 15 is created. The flow spirals and flows in the direction of the arrow Y, accompanied by the scroll flow path internal spiral flow B.

Therefore, during a high flow rate operation, when a flow is created in the direction of the arrow Y (FIG. 11B) accompanied by the scroll flow path internal spiral flow B, by forming the shift chamber 34 in the scroll flow path at the winding start portion 17, interference between the scroll flow path internal spiral flow B and the diffuser outlet flow A is prevented in a similar manner to the first embodiment described above by conforming the direction of the diffuser outlet flow A to the flow of the scroll flow path internal spiral flow B and minimizing the occurrence of a ridge line P in the vicinity of the tongue portion to reduce ridge line distance. As a result, an occurrence of separation in the vicinity of the tongue portion attributable to the interference is minimized and flow loss is reduced.

As shown, in the first embodiment described above, the shift chamber 32 is formed at the winding end portion 19. However, with a configuration in which the shift chamber 32 is only formed at the winding end portion 19, it is difficult to prevent interference during a high flow rate operation between the scroll flow path internal spiral flow B and the diffuser outlet flow A in the scroll flow path 13 (the winding end portion 19) that is oriented from the winding start portion 17 toward (in the direction of the arrow Y) the outlet flow path 15 (the winding end portion 19). However, in the second embodiment, by forming the shift chamber 34 in the scroll flow path 13 at the winding start portion 17, loss in the scroll flow path 13 caused by a flow oriented from the vicinity of the tongue portion 25 toward the outlet flow path 15 is reduced and, as a result, flow loss attributable to a flow oriented from the vicinity of the tongue portion 25 toward the outlet flow path 15 during a high flow rate operation can be reduced.

(Third Embodiment)

Next, a third embodiment will be described with reference to FIG. 5.

The third embodiment is characterized in that a shift chamber 36 is formed in the scroll flow path 13 over an entire circumferential direction in addition to the first and second embodiments.

Figure 5:
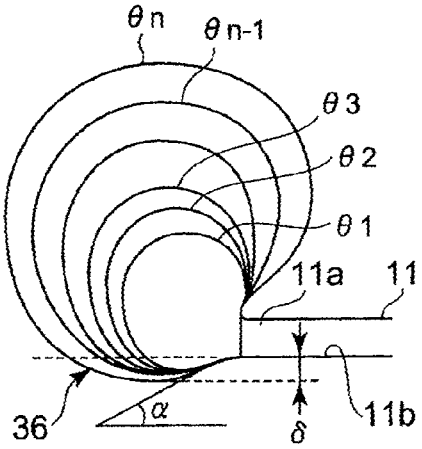
FIG. 5 is an explanatory diagram showing a third embodiment of a scroll cross-sectional shape.

As shown in FIG. 5, the shift chamber 36 is formed, in the circumferential direction, over an entire range of the winding angle θ from $\theta_1$ to $\theta_n$. In addition, while the shift amount δ of the shift chamber 36 is kept constant as depicted by a dashed-dotted line L3 in FIG. 8, the shift amount δ of the shift chamber 36 need not necessarily be constant over the entire circumference. An optimum setting may be adopted by respectively setting different shift amounts δ for the winding end portion 19 and the winding start portion 17 and other portions.

Furthermore, a lower surface of the shift chamber 36 may be formed by an inclined surface that is set at an inclination angle α with respect to an end portion of the bottom surface at the outlet 11*a* of the diffuser 11 instead of by an arc surface. This is similar to the first and second embodiments.

In addition, since the shift chamber 36 is formed over the entire circumference, operational effects attributable to the shift chambers formed in the winding start portion 17 and the winding end portion 19 according to the first and second embodiments described above are produced. At the same time, compared to forming a shift chamber in one portion in the circumferential direction, manufacturing is simplified and flow loss in the circumferential direction in the scroll flow path 13 can be minimized.

In addition, when an inclined surface is formed on the bearing housing 50 as shown in FIG. 3C, there is an advantage that the bearing housing 50 can be uniformly cut in the circumferential direction and manufacturing becomes particularly easy.

Furthermore, a core installation error during manufacturing by casting can be absorbed.

In other words, when manufacturing a scroll by casting, a core is installed at a corresponding portion in a scroll flow path. However, since the core is simply placed inside a cast, a posture of the core is extremely unstable. Therefore, with a cast scroll, an abrupt expansion or a difference in level of the flow path may occur due to inconsistency with a bottom surface of the diffuser.

Since the core is only supported at the outlet portion of the scroll, the tendency described above is particularly notable in cross sections at positions with winding angles θ of 180° to 270° which are distant from bottom surface of the scroll is positioned below the bottom surface of the diffuser by the shift amount δ over the entire circumference of the scroll cross section, even if a misalignment of the core occurs during casting, as long as the amount of misalignment is equal to or less than the shift amount δ of the scroll cross section, manufacturing can be carried out in a stable manner without any inconveniences with respect to the misalignment of the core during casting.

(Fourth Embodiment)

Next, a fourth embodiment will be described with reference to FIG. 6.

The fourth embodiment is characterized in that a shape of an opening 39 where the winding start portion 17 connects to the winding end portion 19 of the scroll flow path 13 is formed in a flat shape having a height that is equal to a width of the outlet portion 11*a* of the diffuser 11, a shift chamber is provided on one side of the flat shape, and a height of the shift chamber varies along the circumferential direction.

Three examples will be described below, namely, a case where a shift chamber is provided at the winding end portion, a case where shift chambers are provided at both the winding end portion and the winding start portion, and a case where a shift chamber is provided over the entire circumferential direction. It should be noted that these three examples respectively correspond to the first to third embodiments described earlier.

Figure 6A:
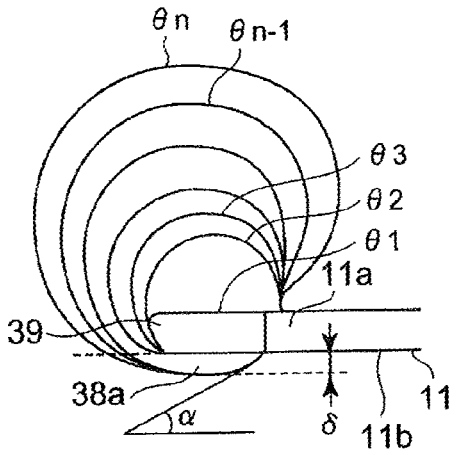
FIG. 6A represents a case corresponding to the first embodiment where a shift chamber is provided at a winding end portion.

The first example shown in FIG. 6A represents a structure of the opening 39 in which the cross-sectional shape of the scroll flow path 13 is formed in a flat shape having a height that is equal to a width W of the outlet portion 11*a* of the diffuser 11 and a shift chamber 38*a* is provided on one side (a bottom surface 11*b*) of the flat shape.

The shift chamber 38*a* is provided in the scroll flow path 13 at the winding end portion 19 in a similar manner to the first embodiment. As exemplified by shapes at positions $\theta_n$ and $\theta_{n-1}$ in FIG. 3, the cross-sectional shape is shifted downward by a shift amount δ from the bottom surface 11*b* of the outlet portion 11*a* of the diffuser 11.

In addition, a lower surface of the shift chamber 38*a* may be formed by an inclined surface that is set at an inclination angle α with respect to an end portion of the bottom surface 11*b* of the diffuser 11 instead of by an arc surface. The shift amount δ and the shift position are similar to those in the description of the first embodiment.

An effect produced by providing the shift chamber 38*a* in the scroll flow path 13 at the winding end portion 19 is the same as in the first embodiment. Since a direction of the diffuser outlet flow A can be conformed to the flow of the scroll flow path internal spiral flow B, interference between the diffuser outlet flow A and the scroll flow path internal spiral flow B can be prevented and an occurrence of separation in the vicinity of the tongue portion 25 attributable to the interference can be minimized.

In addition to the effect of preventing a separation from occurring, since the shape of the opening 39 is formed in a flat shape with a height that is equal to a width of the outlet portion 11*a* of the diffuser 11, since a circulation area can be reduced in comparison to a connection having a circular cross-sectional shape, inflow of the recirculating flow (the arrow Z in FIG. 11A) from the output flow path (the winding end portion 19 of the scroll flow path 13) toward the vicinity of the tongue portion 25 that is created during a low flow rate operation can be minimized.

Figure 10B:
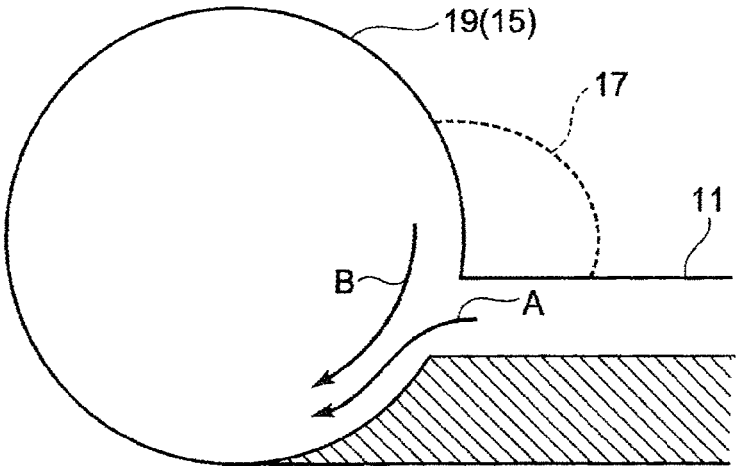

In addition, as shown in FIG. 10B, since the opening 39 of the winding start portion 17 is formed in a flat shape having a height that is equal to a width of the outlet portion 11*a* of the diffuser 11, inflow of the scroll flow path internal spiral flow B in the outlet flow path 15 (the winding end portion 19 of the scroll flow path) as an inflow E into the scroll flow path 13 at the winding start portion 17 is prevented. As a result, flow loss due to separation in an arc-shaped cross section of the winding start portion such as that shown in FIG. 10A can be reduced.

Figure 6B:
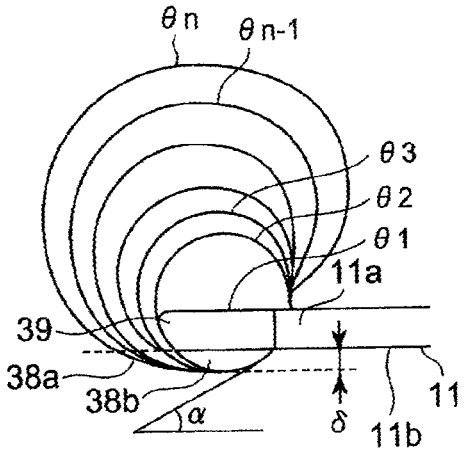
FIG. 6B represents a case corresponding to the second embodiment where shift chambers are provided at a winding end portion and a winding start portion.

The second example shown in FIG. 6B represents a structure of the opening 39 in which the cross-sectional shape of the scroll flow path 13 is formed in a flat shape having a height that is equal to the width W of the outlet portion 11*a* of the diffuser 11 and, in addition to the shift chamber 38*a* provided at the winding end portion 19, a shift chamber 38*b* is also provided at the winding start portion 17. By adopting such a configuration, an operational effect similar to that of the second embodiment described earlier is produced in addition to the operational effect of the first example shown in FIG. 6A.

Figure 6C:
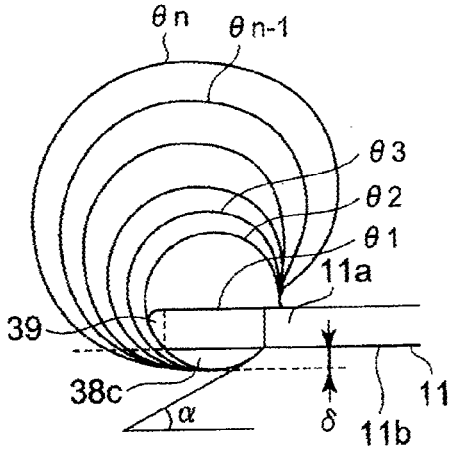
FIG. 6C represents a case corresponding to the third embodiment where a shift chamber is provided over an entire range in a circumferential direction.

The third example shown in FIG. 6C represents a structure of the opening 39 in which the cross-sectional shape of the scroll flow path 13 is formed in a flat shape having a height that is equal to the width W of the outlet portion 11*a* of the diffuser 11 and a shift chamber 38*c* is provided over the entire circumferential direction. By adopting such a configuration, an operational effect similar to that of the third embodiment described earlier is produced in addition to the operational effect of the first example shown in FIG. 6A.

(Fifth Embodiment)

Next, a fifth embodiment will be described with reference to FIG. 7.

The fifth embodiment is a modification of the fourth embodiment and is similar to the fourth embodiment in that a shape of the opening 39 where the winding start portion 17 connects to the winding end portion 19 of the scroll flow path 13 is formed in a flat shape having a height that is equal to a width of the outlet portion 11*a* of the diffuser 11, a shift chamber 40 is provided on one side of the flat shape, and a height of the shift chamber 40 varies along the circumferential direction.

However, the fifth embodiment is characterized in that the flat shape changes to a circular shape at $\theta_2$ and $\theta_3$ such that one of the flat surfaces of the opening 39 having a height that is equal to a height of the diffuser 11 is conformed to one side of the diffuser 11 in the height direction, a surface of the opening 39 which opposes the outlet portion 11*a* of the diffuser 11 is formed in an arc shape, and the arc shape changes so as to gradually expand and return to a circular shape.

Figure 7:
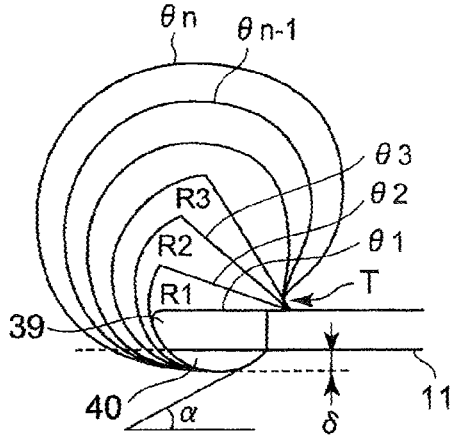
FIG. 7 is an explanatory diagram showing a fifth embodiment of a scroll cross-sectional shape.

Specifically, as shown in FIG. 7, a shape of a flat connection A is attained at a winding angle $\theta_0$=60° of the position of the tongue portion 25, an arc shape with a radius R1 in which the shift chamber 40 is formed on one side of the flat-shaped opening 39 and in which an arc center of the arc shape is positioned at an end portion T of the outlet portion 11*a* of a height surface of the diffuser 11 is attained at $\theta_1$ that represents a change of a certain angle Δθ from the angle $\theta_0$, an arc shape with a radius R2 is attained at $\theta_2$ that represents a change of a certain angle Δθ from the angle $\theta_1$, and an arc shape with a radius R3 is attained at $\theta_3$ that represents a change of a certain angle Δθ from the angle $\theta_2$.

By adopting such a configuration, a flow discharged from the diffuser 11 proceeds as a spiral flow that is increasingly biased toward the outer circumference of the scroll. Therefore, by sequentially expanding the arc shape to attain a circular shape by conforming to the flow, a shape change in accordance with the flow discharged from the diffuser 11 can be realized. As a result, unnecessary changes in cross-sectional shapes can be avoided and a return to a circular shape can be realized in a smoother and more efficient manner.

In addition, in the fifth embodiment, a smooth flow inside the scroll flow path 13 can be realized due to an efficient cross-sectional shape, and since there is no excess shape with respect to the spiral flow, a compact and downsized cross-sectional shape can be formed which contributes to downsizing and weight reduction of an entire compressor.

Furthermore, as in the case of the fourth and fifth embodiments, due to a combination of the flat-shaped opening 39 and the shift chambers 38 and 40, flow loss can be reduced over a wide operation range from a low flow rate to a high slow rate. As a result, improved performance of the centrifugal compressor can be expected.

INDUSTRIAL APPLICABILITY

The present invention is suitably used in a scroll of a centrifugal compressor since a cross-sectional shape of a scroll including a connection to a diffuser outlet in the vicinity of a tongue portion of a scroll flow path as well as over an entire circumference of the scroll is reviewed and an improvement in an effect of loss reduction over a wide operating range including high flow rate operations and low flow rate operations can be expected.

The invention claimed is:

1. A scroll structure of a centrifugal compressor comprising a rotary impeller and a diffuser which is provided on an outer circumferential side of the impeller, and a scroll flow path which is formed in a spiral shape that connects to an outer circumference of the diffuser, and a diffuser outlet connected to the scroll flow path, wherein an axial cross-sectional shape of the scroll flow path has a roughly circular shape, the diffuser outlet is connected to the scroll flow path a position that is aligned with a tangential portion of the roughly circular cross section, the cross sectional shape of the scroll flow path changes such that the relative position of the diffuser outlet is aligned closer to the center of the roughly circular cross section but is not aligned with the center of the cross sectional shape, the roughly circular cross sectional shape is formed from a scroll chamber which juts out in a first axial direction relative to the position of the diffuser outlet and a shift chamber that forms a remainder of the roughly circular shape in a second axial direction opposite to the scroll chamber, and the shift chamber is at least formed on the scroll flow path of a winding end portion in a circumferential direction of a spiral when a winding angle θ in a clockwise direction is set so that a line connecting a position of a tongue portion and the circle center, in a view from an axial line direction of the rotary impeller is at a position of approximately 60 degrees as a winding angle θ of the scroll flow path, the shift chamber is formed beginning at a position approximately 180 degrees preceding the winding end portion of the scroll flow path in a circumferential direction, the dimension of the shift chamber increasing so as to reach maximum at a position of approximately 360 degrees, the dimension of the shift chamber increasing linearly or parabolically as a circumferential angle increases.

2. The scroll structure of a centrifugal compressor according to claim 1, wherein the shift chamber is further formed in the scroll flow path of a winding start portion.

3. The scroll structure of a centrifugal compressor according to claim 2, wherein a shape of a connection opening of the scroll flow path of the winding start portion to the winding end portion is formed in a flat shape having a height that is equal to a width of the diffuser outlet, the shift chamber is provided on one side of the flat shape, and a height of the shift chamber varies in the circumferential direction.

4. The scroll structure of a centrifugal compressor according to claim 1, wherein the shift chamber is formed on the entire scroll flow path in the circumferential direction.

5. A scroll structure of a centrifugal compressor comprising a rotary impeller and a diffuser which is provided on an outer circumferential side of the impeller, and a scroll flow path which is formed in a spiral shape that connects to an outer circumference of the diffuser, and a diffuser outlet connected to the scroll flow path, wherein an axial cross-sectional shape of the scroll flow path has a roughly circular shape, the diffuser outlet is connected to the scroll flow path in a position that is aligned with a tangential portion of the roughly circular cross section, the cross-sectional shape of the scroll flow path changes such that the relative position of the diffuser outlet is aligned closer to the center of the roughly circular cross section but is not aligned with the center of the cross sectional shape, the roughly circular cross-sectional shape is formed from a scroll chamber which juts out in a first axial direction relative to the position of the diffuser outlet and a shift chamber that forms a remainder of the roughly circular shape in a second axial direction opposite to the scroll chamber, and the shift chamber is at least formed on the scroll flow path of a winding end portion in a circumferential direction of a spiral, and the shift chamber is further formed in the scroll flow path of a winding start portion.

6. The scroll structure of a centrifugal compressor according to claim 5, wherein a shape of a connection opening of the scroll flow path of the winding start portion to the winding end portion is formed in a flat shape having a height that is equal to a width of the diffuser outlet, the shift chamber is provided on one side of the flat shape, and a height of the shift chamber varies in the circumferential direction.

7. The scroll structure of a centrifugal compressor according to claim 5, wherein when a winding angle θ in a clockwise direction is set so that a line connecting a position of a tongue portion and the circle center, in a view from an axial line direction of the rotary impeller is at a position of approximately 60 degrees as a winding angle θ of the scroll flow path, the shift chamber is formed beginning at a position approximately 180 degrees preceding the winding end portion of the scroll flow path in a circumferential direction, the dimension of the shift chamber increasing so as to reach maximum at a position of approximately 360 degrees, the dimension of the shift chamber increasing linearly or parabolically as a circumferential angle increases.

* * * * *